US006290123B1

(12) United States Patent
Pei

(10) Patent No.: US 6,290,123 B1
(45) Date of Patent: Sep. 18, 2001

(54) BOTTOM STRUCTURE FOR COLLAPSIBLE CONTAINER

(75) Inventor: Lei Pei, Stow, OH (US)

(73) Assignee: Inland Paperboard and Packaging, Inc., Indianapolis, IN (US)

( * ) Notice: Subject to any disclaimer, the term of this patent is extended or adjusted under 35 U.S.C. 154(b) by 0 days.

(21) Appl. No.: 09/412,550

(22) Filed: Oct. 5, 1999

Related U.S. Application Data

(60) Provisional application No. 60/103,218, filed on Oct. 6, 1998.

(51) Int. Cl.[7] ..... B65D 5/10; B65D 5/36

(52) U.S. Cl. ..... 229/117; 229/184

(58) Field of Search ..... 229/117, 132, 229/137–139, 183, 184

(56) References Cited

U.S. PATENT DOCUMENTS 1,720,146 7/1929 Reese .
2,348,378 * 5/1944 Goodyear ..... 229/117
2,716,519 * 8/1955 Rafoth et al. ..... 229/117

(List continued on next page.)

FOREIGN PATENT DOCUMENTS 2574755 6/1986 (FR) .
2 243 596 11/1991 (GB) .

*Primary Examiner*—Gary E. Elkins
(74) *Attorney, Agent, or Firm*—Barnes & Thornburg

(57) ABSTRACT

A container includes a four-sided body configured to be folded from an expanded, opened position to a collapsed, flattened position. The four-sided body includes a set of four walls. The container further includes a floor including first and second bottom flaps coupled to first and second walls of the set of four walls. The floor also includes an anchor plate coupled to the second bottom flap and a hinge coupled to the first bottom flap and to the anchor plate to enable pivotable movement of the first bottom flap relative to the second bottom flap about a first pivot axis established by the first hinge during movement of the four-sided body between the collapsed, flattened position and the expanded, opened position.

45 Claims, 4 Drawing Sheets

U.S. PATENT DOCUMENTS

| | | | | |
|---|---|---|---|---|
| 2,826,350 | | 3/1958 | Marx . | |
| 2,858,968 | | 11/1958 | Pellaton . | |
| 2,934,254 | | 4/1960 | Ullger . | |
| 3,083,889 | | 4/1963 | Christensson . | |
| 3,101,167 | | 8/1963 | Styler . | |
| 3,115,291 | | 12/1963 | Kotowick . | |
| 3,132,791 | | 5/1964 | Haysler et al. . | |
| 3,344,971 | | 10/1967 | Walker et al. . | |
| 3,373,917 | | 3/1968 | Cox . | |
| 3,525,466 | | 8/1970 | Robinson . | |
| 3,561,667 | | 2/1971 | Saltman . | |
| 3,565,235 | | 2/1971 | Brown et al. . | |
| 3,642,192 | | 2/1972 | Wilcox, Jr. et al. . | |
| 3,809,310 | | 5/1974 | VanderLugt, Jr. . | |
| 3,877,631 | | 4/1975 | Lai et al. . | |
| 4,007,869 | * | 2/1977 | Stolkin et al. | 229/117 |
| 4,109,985 | | 8/1978 | Lieb, Jr. . | |
| 4,142,666 | * | 3/1979 | Rosenbaum, II | 229/117 |
| 4,146,169 | | 3/1979 | Meyers et al. . | |
| 4,166,567 | | 9/1979 | Beach, Jr. et al. . | |
| 4,185,764 | | 1/1980 | Cote . | |
| 4,199,098 | | 4/1980 | Lopez . | |
| 4,243,171 | | 1/1981 | Prin . | |
| 4,244,510 | | 1/1981 | Snyder et al. . | |
| 4,260,100 | | 4/1981 | Hoffman . | |
| 4,266,716 | * | 5/1981 | Austin | 229/117 |
| 4,289,267 | | 9/1981 | Mayea . | |
| 4,428,499 | | 1/1984 | Nauuheimer . | |
| 4,448,309 | | 5/1984 | Roccaforte et al. . | |
| 4,453,665 | | 6/1984 | Roccaforte et al. . | |
| 4,470,540 | | 9/1984 | Koltz . | |
| 4,549,690 | | 10/1985 | Rosenburg . | |
| 4,582,552 | * | 4/1986 | Fitzgibbon et al. | 229/183 |
| 4,607,785 | | 8/1986 | Croley . | |
| 4,676,429 | | 6/1987 | Crowe et al. . | |
| 4,742,915 | | 5/1988 | Ringer . | |
| 4,747,485 | | 5/1988 | Chaussadas . | |
| 4,760,922 | | 8/1988 | Northgrave . | |
| 4,834,255 | | 5/1989 | Boots . | |
| 4,854,474 | | 8/1989 | Murray et al. . | |
| 4,856,705 | | 8/1989 | Carr et al. . | |
| 4,871,068 | | 10/1989 | Dreyfus . | |
| 4,881,683 | | 11/1989 | Linnemann . | |
| 4,917,289 | | 4/1990 | Linnemann et al. . | |
| 5,040,721 | | 8/1991 | Essack . | |
| 5,115,965 | | 5/1992 | Alepuz . | |
| 5,295,623 | | 3/1994 | Bacques et al. . | |
| 5,413,273 | * | 5/1995 | Money | 229/137 |
| 5,531,374 | | 7/1996 | Gasper . | |
| 5,613,694 | | 3/1997 | Gasper . | |
| 5,630,543 | | 5/1997 | Dugan . | |
| 5,715,991 | | 2/1998 | Gasper . | |
| 5,816,483 | | 10/1998 | Gasper . | |

* cited by examiner

BOTTOM STRUCTURE FOR COLLAPSIBLE CONTAINER

This application claims priority under 35 U.S.C. §119(e) to U.S. Provisional Application Ser. No. 60/103,218, filed Oct. 6, 1998, which is expressly incorporated by reference herein.

BACKGROUND AND SUMMARY OF THE INVENTION

The present invention relates to collapsible containers, and particularly to bottom structures for collapsible containers made of paperboard. More particularly, the present invention relates to a relatively flat bottom structure for a rapid set-up, rectangle-shaped bulk box.

Bulk boxes are containers that are used to store bulk resins, food products, or other items. One problem with many bulk boxes is that it is necessary to fold the bottom flaps manually to create a box floor at the time the box is set up. Additional labor is needed to create a box floor at the time the box is set up. Manual floor set-up is a problem for rectangular and octagonal bulk boxes.

According to the present invention, a container includes a four-sided body and a floor positioned to lie in a bottom opening of the four-sided body upon movement of the four-sided body from a collapsed, flattened position to assume an expanded, opened position. The floor includes first and second floor sections.

The first floor section includes first and second bottom flaps coupled to the four-sided body along fold lines and a first connector. The first connector is coupled to the first and second bottom flaps and arranged to establish a first pivot axis therebetween so that the first bottom flap pivots automatically relative to the second bottom flap during container setup as the four-sided body is moved from its collapsed, flattened position to assume its expanded, opened position.

The second floor section includes third and fourth bottom flaps coupled to the four-sided body along fold lines and a second connector. The second connector is coupled to the third and fourth bottom flaps and arranged to establish a second pivot axis therebetween so that the fourth bottom flap pivots automatically relative to the third bottom flap during container setup as the four-sided body is moved from its collapsed, flattened position to assume its expanded, opened position.

In preferred embodiments, the four-sided body includes a set of four walls arranged consecutively in series to provide the four-sided body with a rectangular shape upon movement of the four-sided body to assume its expanded, opened position. A trapezoid-shaped first bottom flap is coupled to the first wall at a first fold line, a trapezoid-shaped second bottom flap is coupled to the second wall at a second fold line, a rectangle-shaped third bottom flap is coupled to the third wall at a third fold line, and a trapezoid-shaped fourth bottom flap is coupled to the fourth wall at a fourth fold line.

The first connector includes a first anchor plate glued or otherwise coupled to the second bottom flap and a first hinge coupled at one end to the first bottom flap and at the other end to the first anchor plate to establish the first pivot axis in the first floor section. The second connector includes a second anchor plate glued or otherwise coupled to the third bottom flap and a second hinge coupled at one end to the fourth bottom flap and at the other end to the second anchor plate to establish the second pivot axis in the second floor section.

Prior to setup, the four-sided body and the four bottom flaps cooperate to define a sleeve wherein the second and third walls and bottom flaps lie in one plane and the first and fourth walls and bottom flaps lie in a second plane along with the first and second connectors to establish the collapsed, flattened position of the four-sided body. When one force is applied to a fold edge provided between the first and second walls and an opposite force is applied to a fold edge provided between the third and fourth walls, the four walls are moved relative to one another from the collapsed, flattened position to assume the "rectangular" expanded, opened position. Simultaneously, the bottom flaps in the first and second floor sections pivot relative to one another and fold relative to the four walls to create a container floor automatically. The first bottom flap pivots relative to the second bottom flap about the first pivot axis and the fourth bottom flap pivots relative to the third bottom flap about the second pivot axis and the four flaps "intermesh" with one another to form a rectangular flat floor automatically during movement of the four-sided body to assume its expanded, opened position.

Additional features and advantages of the invention will become apparent to those skilled in the art upon consideration of the following detailed description of preferred embodiments exemplifying the best mode Of carrying out the invention as presently perceived.

BRIEF DESCRIPTION OF THE DRAWINGS

The detailed description particularly refers to the following figures in which:

FIG. 5 is a perspective view showing application of a force to each of two corners of the container sleeve of FIG. 4 during an initial stage of sleeve expansion and showing pivoting movement of one of the bottom flaps about a pivot axis established by a hinge interconnecting that bottom flap to an anchor plate adhered to another bottom flap;

FIG. 6 is a perspective view similar to FIG. 5 showing further folding of the outer panel flaps during a later stage of sleeve expansion;

FIG. 7 is a perspective view similar to FIG. 6 showing formation of the floor upon erection of the container.

DETAILED DESCRIPTION OF THE DRAWINGS

Figure 1:
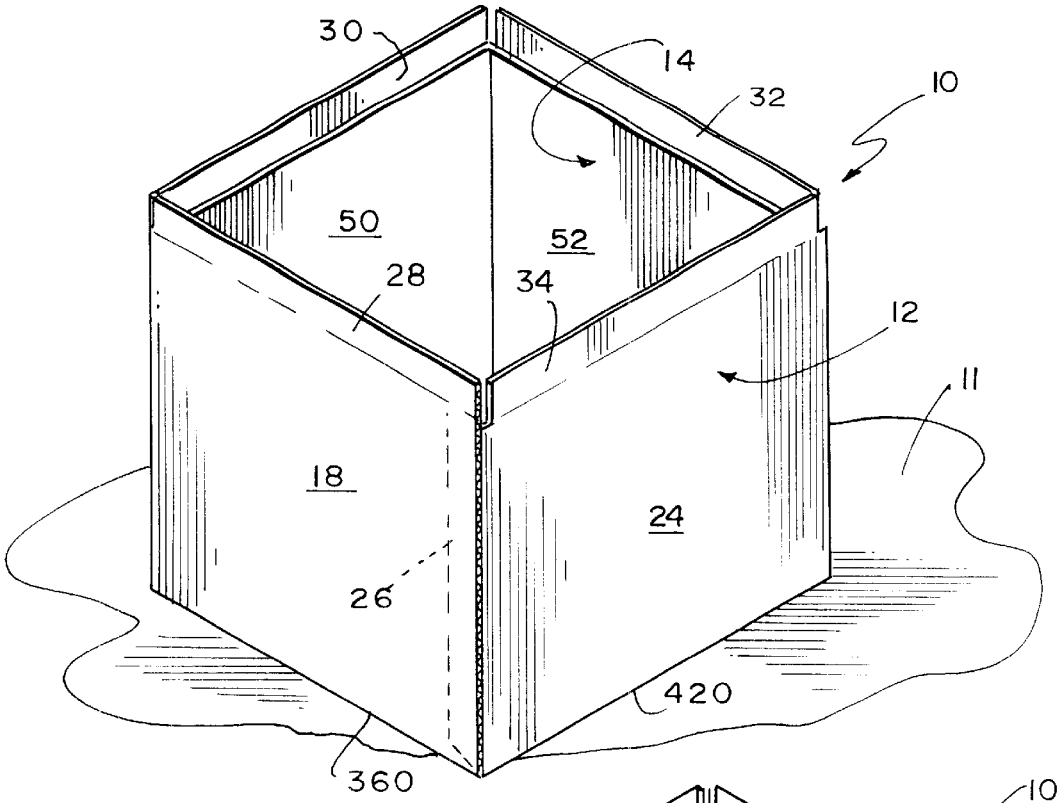
FIG. 1 is a perspective view of an erected container in accordance with the present invention showing vertical side walls included in the container and a rectangle-shaped top opening defined by upper edges of the container side walls.

A collapsible container 10 having four side walls and a foldable bottom structure is shown setting on a flat surface 11 in FIG. 1. Container 10 comprises an outer panel 12 and an inner panel 14 as shown, for example, in FIGS. 1 and 3. The outer and inner panels 12, 14 are coupled (e.g., glued) together to form a body that can be assembled to provide a container sleeve 15 shown, for example, in FIG. 4. It is within the scope of this disclosure to construct a container using only outer panel 12.

Figure 2:
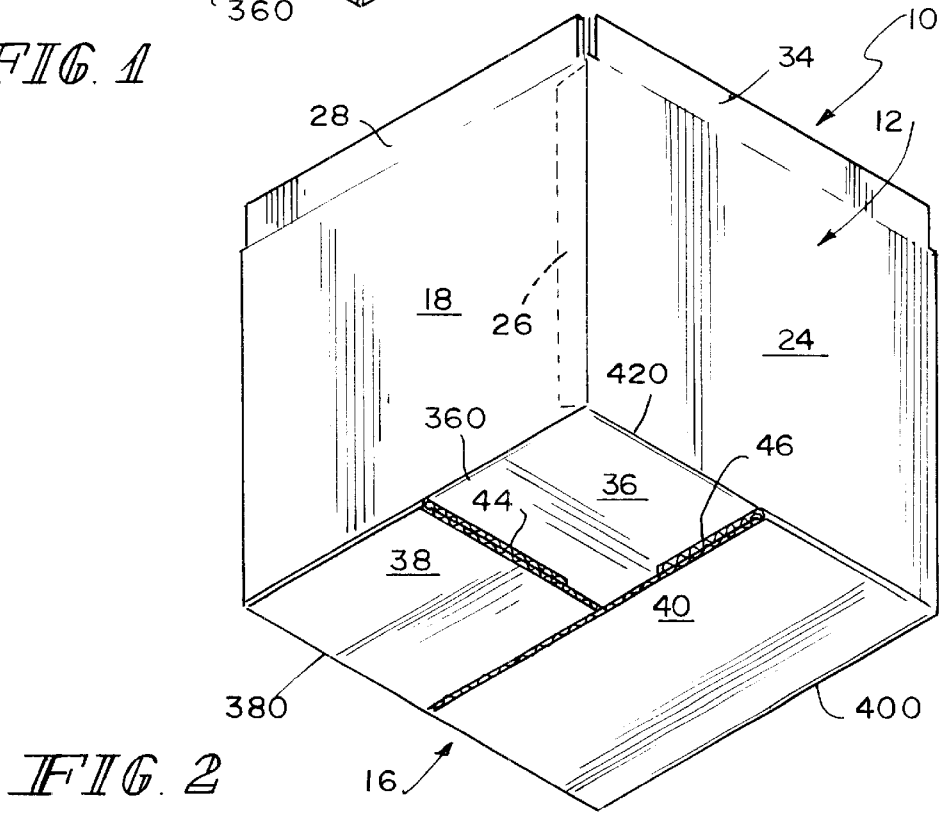
FIG. 2 is a perspective view of the container of FIG. 1 from a point underneath the container showing an arrangement of bottom flaps that cooperate to form the floor of the container.
Figure 3:
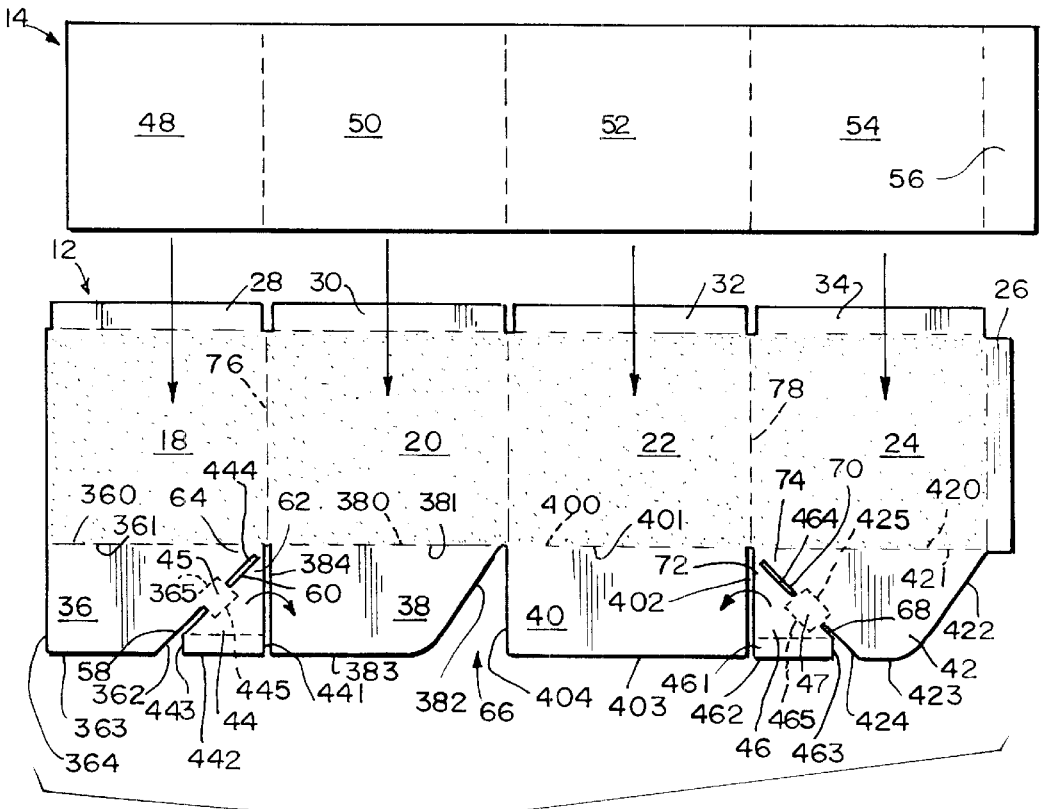
FIG. 3 is a plan view of a first blank used to define an inner panel of the container and a second blank used to define an outer panel of the container and showing adhesive (represented by a pattern of dots) applied to four side walls of the outer panel to enable the inner panel to be adhered to the outer panel and showing four bottom flaps and two anchor plates appended to bottom edges of the outer panel side walls and configured to form the floor of the container once it is erected as shown in FIG. 2.
Figure 5:
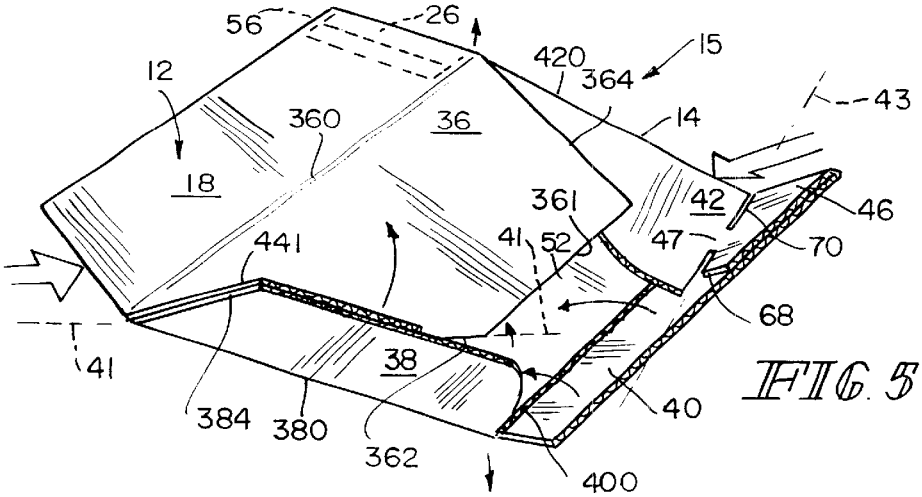
FIGS. 5–7 show a sequence wherein various external forces are applied to the container sleeve shown in FIG. 4 to expand the container sleeve from the collapsed, flattened position to an upright, opened position.
Figure 6:
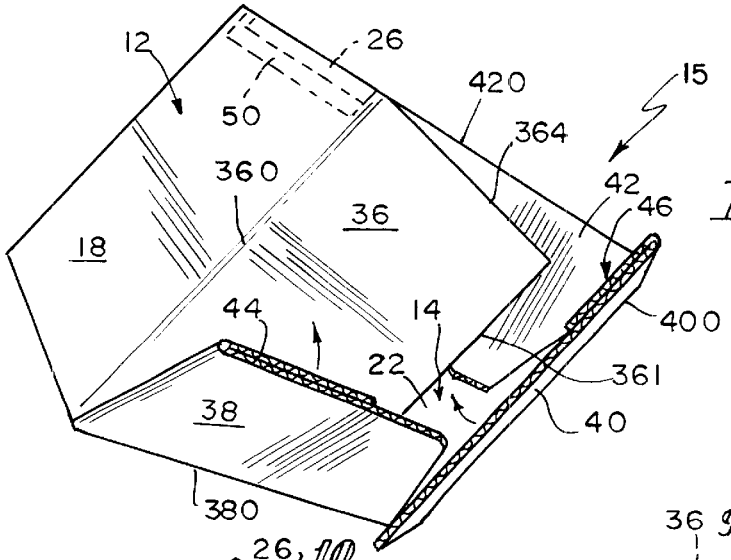

Outer panel 12 includes various bottom flaps shown, for example, in FIG. 3 that cooperate to define a floor 16 of container 10 once container sleeve 15 is expanded and manipulated as shown, for example, in FIGS. 5 and 6 to form an erected container shown, for example, in FIGS. 2 and 7–9. Outer panel 12 includes two pairs of hinged bottom flaps that cooperate to define container floor 16.

Outer panel 12 is a die-cut blank made of a single piece of paperboard such as a corrugated material. As shown in FIG. 3, outer panel 12 includes, in series, a first wall 18, second wall 20, third wall 22, fourth wall 24, and connection flange 26. Scored fold lines between adjacent walls are represented by dotted lines and adhesive is represented by a pattern of dots. Each of top flaps 28, 30, 32, 34 is appended to a top edge of one of the walls 18, 20, 22, 24 as shown, for example, in FIG. 3. Each of bottom flaps 36, 38, 40, 42 is appended to a bottom edge of one of the walls 18, 20, 22, 24 as shown, for example, in FIG. 3. Bottom flaps 36, 38, 40, 42 cooperate to 30 define container floor 16 once container sleeve 15 is expanded and manipulated as shown, for example, in FIGS. 4–7. These bottom flaps 36, 38, 40, 42 will be described in more detail below in connection with a description of container floor 16.

Inner panel 14 is also a die-cut blank made of a single piece of paperboard such as a corrugated material. As shown in FIG. 3, inner panel 14 includes, in series, a first wall 48, second wall 50, third wall 52, fourth wall 54, and connection flange 56. Scored fold lines between adjacent walls are represented by dotted lines.

The bottom flaps 36, 38, 40, and 42 of outer panel 12 are shown in FIG. 3. A first anchor plate 44 is coupled to first bottom flap 36 by a first hinge 45 and configured to be coupled (e.g., glued) to second bottom flap 38 (using, e.g., adhesive represented by a pattern of dots) to enable pivotable movement of first bottom flap 36 relative to second bottom flap 38 about a first pivot axis 41 established by first hinge 45. A second anchor plate 46 is coupled to fourth bottom flap 42 by second hinge 47 and configures to be coupled (e.g., glued) to third bottom flap 40 (using, e.g., adhesive represented by a pattern of dots) to enable pivotable movement of fourth bottom flap 42 relative to third bottom flap 40 about a second pivot axis 43 established by second hinge 47.

First bottom flap 36 has a trapezoidal shape and has two parallel edges 361, 363, the longer (361) of which is appended to a bottom edge of first wall 18 along a scored first fold line 360 as shown in FIG. 3. First bottom flap 36 also includes a diagonal, sloping hinge edge 362, which edge 362 is appended to hinge 45 "along" a scored fold line 365. The sloping hinge edge 362 is arranged to lie at an acute angle relative to first fold line 360 as shown, for example, in FIGS. 3 and 4. First bottom flap 36 further includes a perpendicular edge 364 arranged to lie at a right angle relative to first fold line 360 as also shown, for example, in FIGS. 3 and 4.

First anchor plate 44 has a trapezoidal shape and has two parallel edges 441, 443, the longer (441) of which is positioned to lie in spaced-apart parallel relation to a straight side edge 384 of second bottom flap 38 when outer panel 12 is formed as shown in FIG. 3. First anchor plate 44 also includes a diagonal, sloping hinge edge 444, which edge 444 is appended to first hinge 45 "along" a scored fold line 445 and arranged to define a pair of slots 58, 60 lying between first bottom flap 36 and first anchor plate 44. Slots 58, 60 are separated from one another by first hinge 45. An upper corner 62 of first anchor plate 44 is appended to an upper comer 64 of first bottom flap 36 as shown in FIG. 3. First anchor plate 44 further includes an outer side edge 442 arranged to lie in spaced-apart parallel relation to first fold line 361 as shown, for example, in FIGS. 3 and 4. It is within the scope of this disclosure to add a "third comer" (not shown) to first anchor plate 44 at "edge 443" to cause first anchor plate 44 to have a triangular shape.

Figure 4:
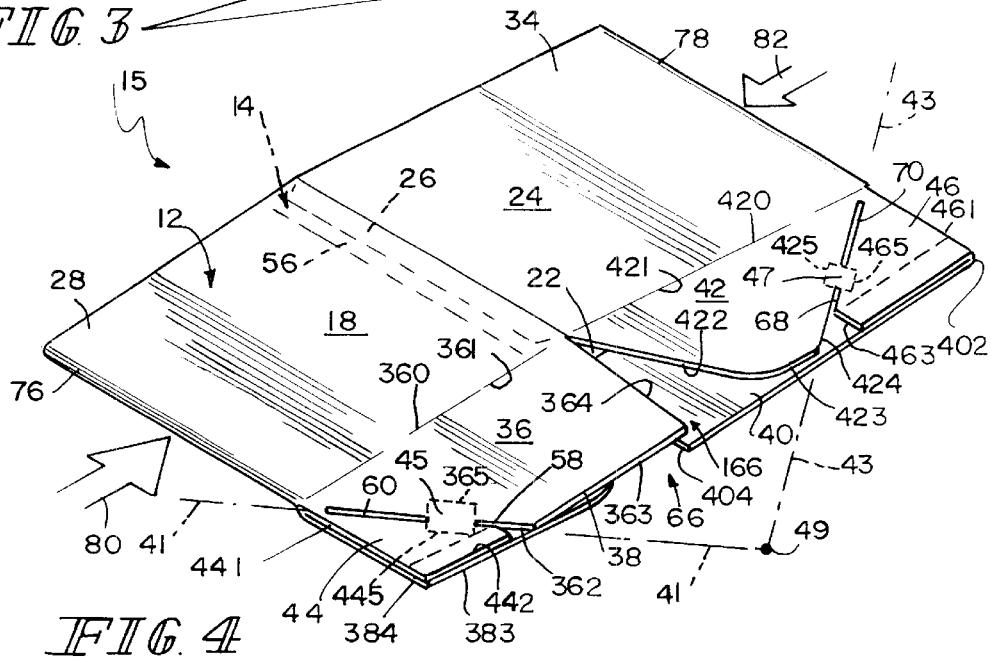
FIG. 4 is a perspective view of the inner and outer panels of FIG. 3 after the panels have been partly assembled to define a container sleeve lying in a collapsed, flattened position and before manipulation of the inner and outer panels and the bottom flaps included in the outer panel to form the floor of the container.

Second bottom flap 38 has a trapezoidal shape and has two parallel edges 381, 383, the longer (381) of which is appended to a bottom edge of second wall 20 along a scored fold line 380 as shown in FIG. 3. Second bottom flap 38 also includes a diagonal, sloping hinge edge 382, which edge 382 cooperates with a straight edge 404 of third bottom flap 40 to define a somewhat "triangle-shaped" opening 66 therebetween as shown in FIGS. 3 and 4. Second bottom flap 38 further includes a straight edge 384 that is arranged to lie at a right angle to second fold line 380 as shown, for example, in FIG. 3. Straight edge 384 of second bottom flap 38 and straight edge 441 of first anchor plate 44 cooperate to define a slot therebetween when outer panel 12 is formed as shown, for example, in FIG. 3. These edges 384, 441 are arranged to lie in side-by-side relation one to another upon formation of sleeve 15 and movement of sleeve 15 to assume a collapsed, flattened position as shown, for example, in FIG. 4.

Figure 7:
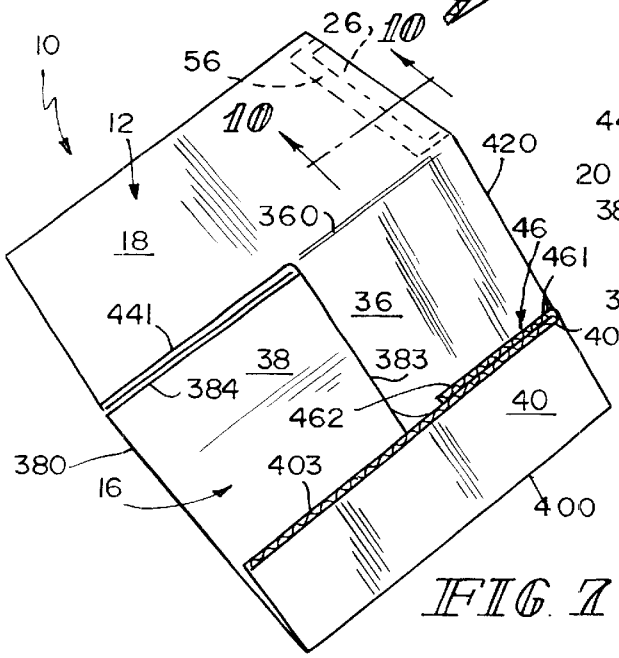

Third bottom flap 40 has a rectangular shape and has a long edge 401 appended to a bottom edge of third wall 22 along a scored fold line 400 as shown in FIG. 3. Third bottom flap 40 is also shown in FIGS. 2 and 7. Third bottom flap 40 further includes another long edge 403 arranged to lie in spaced-apart parallel relation to long edge 401 and a pair of spaced-apart parallel short perpendicular edges 402, 404 as shown, for example, in FIG. 3. Each perpendicular edge 402, 404 is arranged to lie at a right angle relative to third fold line 400 as shown best in FIG. 3.

Fourth bottom flap 42 has a trapezoidal shape and two parallel edges 421, 423, the longer (421) of which is appended to a bottom edge of fourth wall 24 along a scored fold line 420 as shown in FIG. 3. Fourth bottom flap 42 also includes a diagonal, sloping hinge edge 424, which edge 424 is appended to second hinge 47 "along" a scored fold line 425. Fourth bottom flap 42 includes a sloping free edge 422 that cooperated with a perpendicular edge 364 on the first bottom flap 36 to define a somewhat "triangle-shaped" opening 166 therebetween upon movement of sleeve 15 to the collapsed, flattened position as shown, for example, in FIG. 4.

Second anchor plate 46 has a trapezoidal shape and two parallel edges 461, 463, the longer (461) of which is positioned to lie in spaced-apart relation to short perpendicular edge 402 of third bottom flap 40 when outer panel 12 is formed as shown in FIG. 3. Second anchor plate 46 also includes a diagonal, sloping hinge edge 464, which edge 464 is appended to second hinge 47 "along" a scored fold line 465 and arranged to define a pair of slots 68, 70 lying between bottom flap 42 and second anchor plate 46 as shown, for example, in FIGS. 3 and 4. Slots 68, 70 are separated from one another by second hinge 47. An upper corner 72 of second anchor plate 46 is appended to an upper corner 74 of bottom flap 42 as shown in FIG. 3. Second anchor plate 46 further includes an outer side edge 462 arranged to lie in spaced-apart parallel relation to fourth fold line 420 as shown, for example, in FIGS. 3 and 4. Longer edge 461 of second anchor plate 46 and short perpendicular edge 402 of third bottom flap 40 cooperate to define a slot therebetween when outer panel 12 is formed as shown, for example, in FIG. 3. It is within the scope of this disclosure to add a "third corner" (not shown) to second anchor plate 46 at "edge 463" to cause second anchor plate 46 to have a triangular shape.

As shown, for example, in FIG. 3, first bottom flap 36, first hinge 45, and first anchor plate 44 are formed in a single piece of paperboard so that one end of first hinge 45 is integral to first bottom flap 36 and the opposite end of first hinge 45 is integral to first anchor plate 44. Fourth bottom flap 42, second hinge 47, and second anchor plate 46 are also formed in that same piece of paperboard as shown, for example, in FIG. 3. One end of second hinge 47 is integral to fourth bottom flap 42 and on opposite end of second hinge 47 is integral to second anchor plate 46.

As shown, for example, in FIGS. 4 and 7, perpendicular edge 402 of third bottom flap 40 is arranged to lie in side-by-side parallel relation to perpendicular edge 461 of second anchor plate 46 when sleeve 15 is in the collapsed, flattened position. Also, perpendicular edge 384 of second bottom flat 38 is arranged to lie in side-by-side parallel relation to perpendicular edge 441 of first anchor plate 44 when sleeve 15 is in the collapsed, flattened position. As also shown in FIG. 4, first and second hinges 45, 47 are arranged relative to walls 18, 20, 22, 24 to cause first and second pivot axes 41, 43 established by hinges 45, 47 to converge at convergence point 49 spaced away from walls 18, 20, 22, 24. Convergence point 49 is located as shown in FIG. 4 to position bottom flaps 36, 38, 40, 42 and anchor plates 44, 46 to lie between walls 18, 20, 22, 24 and convergence point 49 when sleeve 15 lies in the collapsed, flattened position. Also, as shown, for example, in FIG. 8, first and second hinges 45, 47 are arranged relative to bottom flaps 36, 38, 40, 42 to cause first and second pivot axes 41, 43 to align in collinear relation to one another upon movement of sleeve 15 to assume the expanded, opened position.

As shown, for example, in FIGS. 4 and 5, first anchor plate 44 and first hinge 45 cooperate to define a first connector coupled to first and second bottom flaps 36, 38 to enable pivotable movement of first bottom flap 36 relative to second bottom flap 38 about first pivot axis 41 during movement of sleeve 15 between the collapsed, flattened position and the expanded, opened position. Also, second anchor plate 46 and second hinge 47 cooperate to define a second connector coupled to third and fourth bottom flaps 40, 42 to enable pivotable movement of fourth bottom flap 42 relative to third bottom flap 40 about second pivot axis 43 during movement of sleeve 15 between the collapsed, flattened position and the expanded, opened position.

During a first stage of container construction, inner panel 14 is coupled (e.g., glued) to outer panel 12 so that the following pairs of walls and flanges are aligned and coupled as suggested in FIG. 3: (18, 48), (20, 50), (22, 52), (24, 54), and (26, 56). The walls and flanges are aligned so that the scored fold lines in inner panel 14 align with the scored fold lines in outer panel 12.

Figure 10:
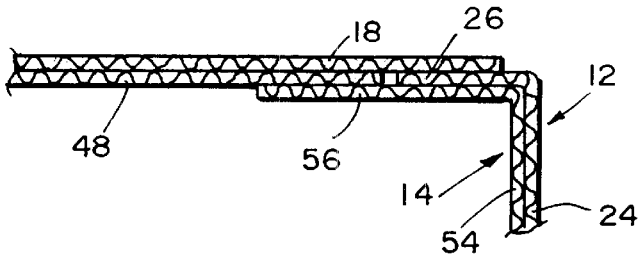
FIG. 10 is a sectional view of a portion of the container taken along line 10—10 of FIG. 7.

In a next stage of container construction, container sleeve 15 is formed in the following manner. First wall 18 is folded about fold line 76 to overlie second wall 20 and first anchor plate 44 is adhered to second bottom flap 38 as shown, for example, in FIG. 4. Fourth wall 24 is folded about fold line 78 to overlie third wall 22 and second anchor plate 46 is adhered to third bottom flap 40 as shown, for example, in FIG. 4. As shown best in FIG. 10, container sleeve 15 is established by coupling connection flange 26 of outer panel 12 to first wall 18 of outer panel 12 and to connection flange 56 of inner panel 14 and by coupling connection flange 56 to first wall 48 of inner panel 4.

As shown in FIG. 4, first bottom flap 36 and first anchor plate 44 lie in coplanar relation to one another and in parallel relation to second bottom flap 38 when sleeve 15 is in the collapsed, flattened position. Third bottom flap 40 and second anchor plate 46 lie in coplanar relation to one another and to first bottom flap 36 and first anchor plate 44 and in parallel relation to second bottom flap 38 and fourth bottom flap 42 when sleeve 15 is in the collapsed, flattened position.

Figure 8:
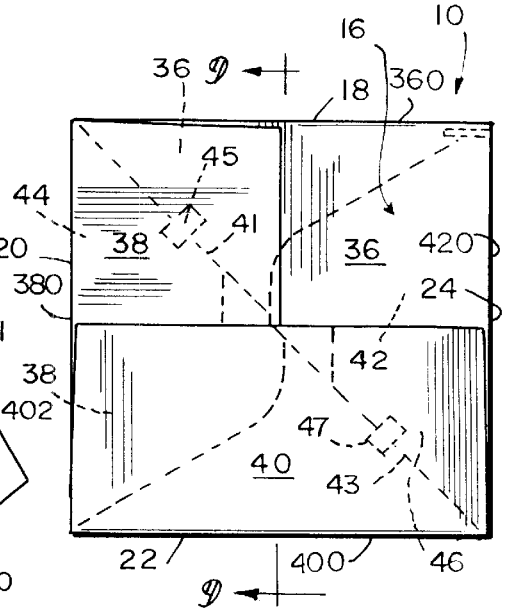
FIG. 8 is a bottom view of the container of FIG. 7.
Figure 9:
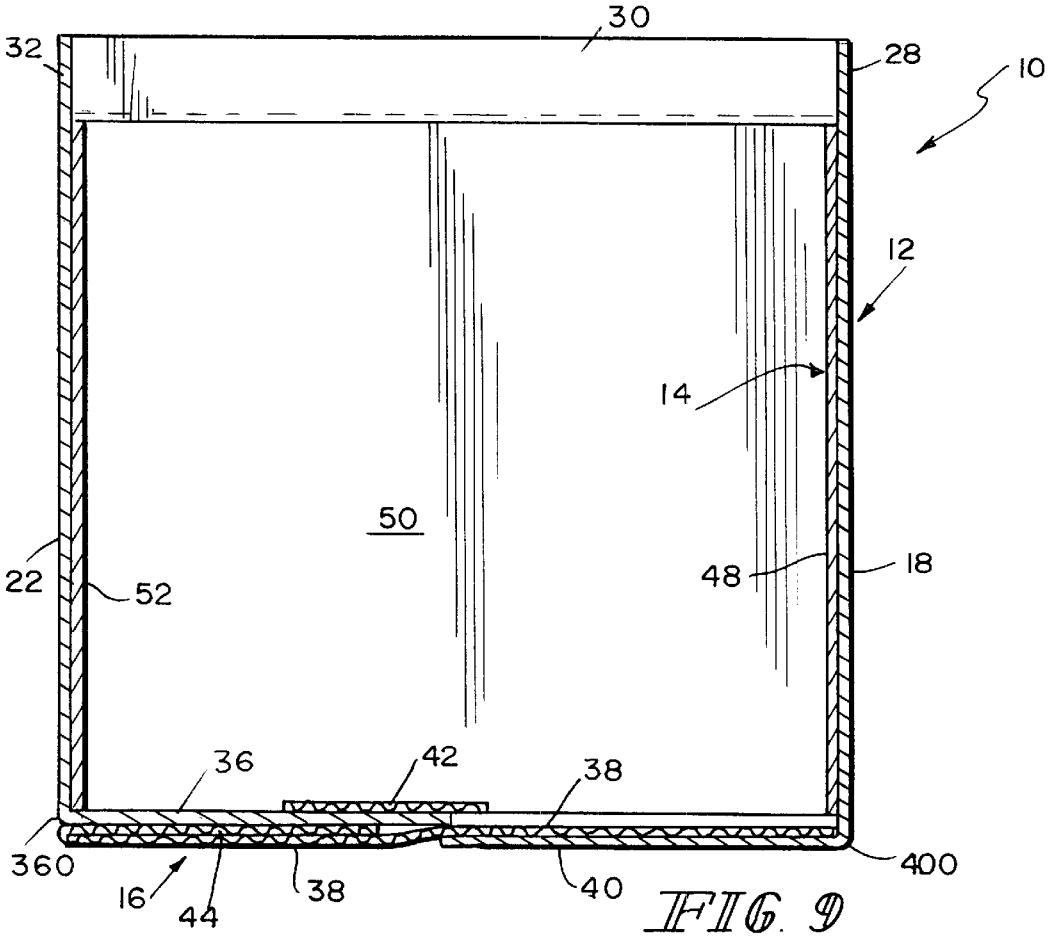
FIG. 9 is a sectional view of the container taken along line 9—9 of FIG. 8.

External force 80 is then applied to corner 76 of container sleeve 15 and, at the same time, external force 82 is applied to corner 78 of container sleeve 15 as shown in FIG. 4 to expand sleeve 15. Sleeve 15 is expanded as shown in FIGS. 5–7 and fourth bottom flap 42 pivots about second hinge 47 relative to third bottom flap 40 and second anchor plate 46 (as fourth bottom flap 42 folds relative to fourth wall 24 and third bottom flap 40 folds relative to third wall 22) while first bottom flap 36 is pivoted about first hinge 45 relative to second bottom flap 38 and first anchor plate 44 (as first bottom flap 36 folds relative to first wall 18 and second bottom flap 38 folds relative to second wall 20). During sleeve expansion, third bottom flap 40 "drives" fourth bottom flap 42 automatically to its floor-forming position and second bottom flap 38 "drives" first bottom flap 36 automatically to its floor-forming position as shown in FIGS. 5–7 to form a floor 16 comprising intermeshed bottom flaps as shown in FIGS. 7–9.

Although the invention has been described in detail with reference to certain preferred embodiments, variations and modifications exist within the scope and spirit of the invention as described and defined in the following claims.

What is claimed is:

1. A container comprising a four-sided body formed to include a top opening and a bottom opening and configured to be folded from an expanded, opened position to a collapsed, flattened position, the four-sided body including a set of four walls arranged consecutively in series to provide the four-sided body with a rectangular shape upon movement of the four-sided body to assume the expanded, opened position, a floor positioned to lie in the bottom opening of the four-sided body upon movement of the four-sided body to assume the expanded, opened position, the floor including a first floor section coupled to first and second walls in the set of four walls and a second floor section coupled to third and fourth walls in the set of four walls, the first floor section includes a first bottom flap coupled to the first wall at a first fold line, a second bottom flap coupled to the second wall at a second fold line, a first anchor plate coupled to the second bottom flap, and a first hinge coupled to the first bottom flap and to the first anchor plate to enable pivotable movement of the first bottom flap relative to the second bottom flap about a first pivot axis established by the first hinge during movement of the four-sided body between the collapsed, flattened position and the expanded, opened position, and the second floor section includes a third bottom flap coupled to the third wall at a third fold line, a fourth bottom flap coupled to the fourth wall at a fourth fold line, a second anchor plate coupled to the third bottom flap, and a second hinge coupled to the fourth bottom flap and to the second anchor plate to enable pivotable movement of the third bottom flap relative to the fourth bottom flap about a second pivot axis established by the second hinge during movement of the four-sided body between the collapsed, flattened position and the expanded, opened position.

2. The container of claim 1, wherein the first bottom flap and the first anchor plate lie in coplanar relation to one another and in parallel relation to the second bottom flap upon movement of the four-sided body to assume the collapsed, flattened position.

3. The container of claim 2, wherein each of the first and second bottom flaps has a trapezoidal shape.

4. The container of claim 3, wherein the first bottom flap includes a sloping hinge edge arranged to lie at an acute angle relative to the first fold line, the first anchor plate includes a sloping hinge edge arranged to lie at an acute angle relative to the first fold line, and the first anchor plate further includes an outer edge arranged to lie at a right angle relative to the first fold line upon movement of the four-sided body to the collapsed, flattened position and in parallel relation to the first fold line upon movement of the four-sided body to the expanded, opened position.

5. The container of claim 2, wherein the third bottom flap and the second anchor plate lie in coplanar relation to one another and to the first bottom flap and the first anchor plate and in parallel relation to the second and fourth bottom flaps upon movement of the four-sided body to assume the collapsed, flattened position.

6. The container of claim 5, wherein each of the first and second bottom flaps has a trapezoidal shape, the third bottom flap has a rectangular shape) the fourth bottom flap has a trapezoidal shape, the first bottom flap includes a sloping hinge edge arranged to lie at an acute angle relative to the first fold line, the first anchor plate includes a sloping hinge edge arranged to lie at an acute angle relative to the first fold line, and the first anchor plate further includes an outer edge arranged to lie at a right angle relative to the first fold line upon movement of the four-sided body to the collapsed, flattened position and in parallel relation to the first fold line upon movement of the four-sided body to the expanded, opened position, the fourth bottom flap includes a sloping hinge edge arranged to lie at an acute angle relative to the fourth fold line, the second anchor plate includes a sloping hinge edge arranged to lie at an acute angle to the fourth fold line, and the second anchor plate further includes an outer edge arranged to lie at a right angle relative to the fourth fold line upon movement of the four-sided body to the collapsed, flattened position and in parallel relation to the fourth fold line upon movement of the four-sided body to the expanded, opened position.

7. The container of claim 1, wherein the first bottom flap includes a sloping hinge edge arranged to lie at an acute angle relative to the first fold line, the first anchor plate includes a sloping hinge edge arranged to lie at an acute angle relative to the first fold line, one end of the first hinge is coupled to the sloping hinge edge of the first bottom flap, and an opposite end of the first hinge is coupled to the sloping hinge edge of the first anchor plate.

8. The container of claim 7, wherein the first bottom flap, the first hinge, and the first anchor plate are formed in a single piece of paperboard and the one end of the first binge is integral to the first bottom flap and the opposite end of the first hinge is integral to the first anchor plate.

9. The container of claim 8, wherein a scored fold line is located at a junction between the first bottom flap and the one end of the first hinge and another scored fold line is located at a junction between the first anchor plate and the opposite end of the first hinge.

10. The container of claim 7, wherein the fourth bottom flap includes a sloping hinge edge arranged to lie at an angle to the fourth fold line, one end of the second hinge is coupled to the sloping hinge edge of the fourth bottom flap, and an opposite end of the second hinge is coupled to the sloping hinge edge of the second anchor plate.

11. The container of claim 10, wherein the fourth bottom flap, the second hinge, and the second anchor plate are formed in a single piece of paperboard and the one end of the second hinge is integral to the fourth bottom flap and the opposite end of the second hinge is integral to the second anchor plate.

12. The container of claim 10, wherein the first and second bottom flaps, the first and second hinges, and the first and second anchor plates are formed in a single piece of paperboard, the one end of the first hinge is integral to the first bottom flap, the opposite end of the first hinge is integral to the first anchor plate, the one end of the second hinge is integral to the fourth bottom flap, and the opposite end of the second hinge is integral to the second anchor plate.

13. The container of claim 1, wherein the first bottom flap has a trapezoidal shape and two parallel edges and a longer one of the two parallel edges is coupled to the first wall at the first fold line.

14. The container of claim 13, wherein the first bottom flap also includes a sloping hinge edge arranged to lie at an acute angle relative to the first fold line and one end of the first hinge is coupled to the first bottom flap along the sloping hinge edge.

15. The container of claim 14, wherein the first anchor plate includes a sloping hinge edge arranged to lie at an acute angle relative to the first fold line, another end of the first hinge is coupled to the first anchor plate, and the sloping hinge edges of the first bottom flap and first anchor plate cooperate to define a pair of slots lying between the first bottom flap and first anchor plate and separated from one another by the first hinge upon movement of the four-sided body to assume the collapsed, flattened position.

16. The container of claim 13, wherein the second bottom flap has a trapezoidal shape and two parallel edges and a longer one of the parallel edges is coupled to the second wall as the second fold line.

17. The container of claim 1, wherein the first bottom flap includes a perpendicular edge arranged to lie at a right angle to the first fold line, the fourth bottom flap includes a sloping free edge arranged to lie at an acute angle to the fourth fold line, and the perpendicular edge of the first bottom flap and the sloping free edge of the fourth bottom flap cooperate to define a triangle-shaped opening therebetween upon movement of the four-sided body to assume the collapsed, flattened position.

18. The container of claim 17, wherein the fourth bottom flap has a trapezoidal shape and two parallel edges, a longer one of the parallel edges is coupled to the fourth wall at the fourth fold line, and the fourth bottom flap further includes a sloping hinge edge arranged to lie at an acute angle to the fourth fold line and coupled to one end of the second hinge.

19. The container of claim 17, wherein the third bottom flap has two parallel long edges, one of the long edges is coupled to the third wall at the third fold line, the third bottom flap also includes a first perpendicular edge arranged to lie at a right angle to the third fold line, the second bottom flap includes a sloping free edge arranged to lie at an acute angle to the second fold line, and the first perpendicular edge of the third bottom flap and the sloping free edge of the second bottom flap cooperate to define a triangle-shaped opening therebetween upon movement of the four-sided body to assume the collapsed, flattened position.

20. The container of claim 19, wherein the third bottom flap further includes a second perpendicular edge arranged to lie at a right angle to the third fold line and the second anchor plate includes a perpendicular edge arranged to lie at a right angle to the third fold line and in side-by-side parallel relation to the second perpendicular edge of the third bottom flap upon movement of the four-sided body to assume the collapsed, flattened position.

21. The container of claim 19, wherein the second bottom flap further includes a perpendicular edge arranged to lie at a right angle to the second fold line and the first anchor plate includes a perpendicular edge arranged to lie at a right angle to the second fold line and in side-by-side parallel relation to the perpendicular edge of the second bottom flap upon movement of the four-sided body to assume the collapsed, flattened position.

22. The container of claim 1, wherein each of the first and second bottom flaps has a trapezoidal shape.

23. The container of claim 22, wherein the fourth bottom flap has a trapezoidal shape.

24. The container of claim 22, wherein the third bottom flap has a rectangular shape and the fourth bottom flap has a trapezoidal shape.

25. The container of claim 1, wherein the first and second hinges are arranged relative to the walls of the four-sided body to cause the first and second pivot axes established by the hinges to converge at a convergence point spaced away from the walls and located to position the bottom flaps and the anchor plates to lie between the walls and said convergence point upon movement of the four-sided body to assume the collapsed flattened position.

26. The container of claim 25, wherein the first and second hinges are arranged relative to the bottom flaps to cause the first and second pivot axes to align in collinear relation to one another upon movement of the four-sided body to assume the expanded, opened position.

27. A container comprising a four-sided body formed to include a top opening and a bottom opening and configured to be folded from an expanded, opened position to a collapsed, flattened position, the four-sided body including a set of four walls arranged consecutively ill series to provide the four-sided body with a rectangular shape upon movement of the four-sided body to assume the expanded, opened position, a floor positioned to lie in the bottom opening of the four-sided body upon movement of the four-sided body to assume the expanded, opened position, the floor including a trapezoid-shaped first bottom flap coupled to the first wall at a first fold line, a trapezoid-shaped second bottom flap coupled to the second wall at a second fold line, a rectangle-shaped third bottom flap coupled to the third wall at a third fold line, and a trapezoid-shaped fourth bottom flap coupled to the fourth wall at a fourth fold line.

28. The container of claim 27, further comprising a first connector coupled to the first and second bottom flaps to cause the first and second bottom flaps to move together relative to the third and fourth bottom flaps and to the four-sided body during movement of the four-sided body between the collapsed, flattened position and the expanded, opened position.

29. The container of claim 28, wherein the first connector includes a first anchor plate coupled to the second bottom flap and a first hinge coupled to the first bottom flap and the first anchor plate to enable pivotable movement of the first bottom flap relative to the second bottom flap about a first pivot axis established by the first hinge during movement of the four-sided body between the collapsed, flattened position and the expanded, opened position.

30. The container of claim 29, wherein the first bottom flap includes a sloping hinge edge arranged to lie at an acute angle relative to the first fold line, one end of the first hinge is coupled to the first bottom flap along the sloping hinge edge thereof, the first anchor plate includes a sloping hinge edge arranged to lie at an acute angle relative to the second fold line and to face toward the sloping hinge edge of the first bottom flap, and another end of the first hinge is coupled to the first anchor plate along the sloping hinge edge thereof.

31. The container of claim 28, further comprising a second connector coupled to the third and fourth bottom flaps to cause the third and fourth bottom flaps to move together relative to the first and second bottom flaps and to the four-sided body during movement of the four-sided body between the collapsed, flattened position and the expanded, opened position, the second connector includes a second anchor plate coupled to the third bottom flap and a second hinge coupled to the fourth bottom flap and the second anchor plate to enable pivotable movement of the third bottom flap relative to the fourth bottom flap about a second pivot axis established by the second pivot axis established by the second hinge during movement of the four-sided body between the collapsed, flattened position and the expanded, opened position.

32. The container of claim 31, wherein the first bottom flap includes a sloping hinge edge arranged to lie at an acute angle relative to the first fold line, one end of the first hinge is coupled to the first bottom flap along the sloping hinge edge thereof, the first anchor plate includes a sloping hinge edge arranged to lie at an acute angle relative to the second fold line and to face toward the sloping hinge edge of the first bottom flap, and another end of the first hinge is coupled to the first anchor plate along the sloping hinge edge thereof, the fourth bottom flap includes a sloping hinge edge arranged to lie at an acute angle relative to the fourth fold line, one end of the second hinge is coupled to the fourth bottom flap along the sloping hinge edge thereof, the second anchor plate includes a sloping hinge edge arranged to lie at an acute angle relative to the fourth fold line and to face toward the sloping hinge edge of the fourth bottom flap, and another end of the second hinge is coupled to the second anchor plate along the sloping hinge edge thereof.

33. The container of claim 27, further comprising a second connector coupled to the third and fourth bottom flaps to cause the third and fourth bottom flaps to move together relative to the first and second bottom flaps and to the four-sided body during movement of the four-sided body between the collapsed, flattened position and the expanded, opened position.

34. The container of claim 33, wherein the second connector includes a second anchor plate coupled to the third bottom flap and a second hinge coupled to the fourth bottom flap and the second anchor plate to enable pivotable movement of the third bottom flap relative to the fourth bottom flap about a second pivot axis established by the second pivot axis established by the second hinge during movement of the four-sided body between the collapsed, flattened position and the expanded, opened position.

35. A container comprising a four-sided body and a pair of floor sections positioned to lie in a bottom opening of the four-sided body to define a floor therein upon movement of the four-sided body from a collapsed, flattened position to assume an expanded, opened position a first of the floor sections includes first and second bottom flaps coupled to the four-sided body along fold lines and a first connector coupled to the first and second bottom flaps and ranged to establish a first pivot axis therebetween to cause the first bottom flap to pivot relative to the second bottom flap during container setup as the four-sided body is moved from the collapsed, flattened position to the expanded, opened position, and a second of the floor sections includes third and fourth bottom flaps coupled to the four-sided body along fold lines and a second connector coupled to the third and fourth bottom flaps and arranged to establish a second pivot axis therebetween to cause the fourth bottom flap to pivot relative to the third bottom flap during container setup as the four-sided body is moved from the collapsed, flattened position to the expanded, opened position, the first bottom flap being positioned to lie in overlapping, parallel relation to the second bottom flap when the four-sided body is in the expanded, opened position, and the fourth bottom flap being positioned to lie in overlapping, parallel relation to the third bottom flap when the four-sided body is in the expanded, opened position, the first bottom flap and the first connector being positioned to he in co-planar relation with one another in the collapsed, flattened position, the fourth bottom flap and the second convector being positioned to lie in co-planar relation with one another in the collapsed, flattened position.

36. A container comprising a four-sided body and a pair of floor sections positioned to lie in a bottom opening of the four-sided body to define a floor therein upon movement of the four-sided body from a collapsed, flattened position to assume an expanded, opened position, a first of the floor sections includes first and second bottom flaps coupled to the four-sided body along fold lines and a first connector coupled to the first and second bottom flaps and arranged to establish a first pivot axis therebetween to cause the first bottom flap to pivot relative to the second bottom flap during container setup as the four-sided body is moved from the collapsed, flattened position to the expanded, opened position, and a second of the floor sections includes third and fourth bottom flaps coupled to the four-sided body along fold lines and a second connector coupled to the third and fourth bottom flaps and arranged to establish a second pivot axis therebetween to cause the fourth bottom flap to pivot relative to the third bottom flap during container setup as the four-sided body is moved from the collapsed, flattened position to the expanded, opened position, wherein the first connector includes a first anchor plate coupled to the second bottom flap and a first hinge coupled at one end to the first bottom flap and at an opposite end to the first anchor plate to establish the first pivot axis.

37. The container of claim 36, wherein the first bottom flap and the first anchor plate lie in coplanar relation to one another and in parallel relation to the second bottom flap upon movement of the four-sided body to assume the collapsed, flattened position.

38. The container of claim 36, wherein each of the first and second bottom flaps has a trapezoidal shape.

39. The container of claim 36, wherein the first bottom flap is coupled to the four-sided body along a first fold line, the first bottom flap includes a sloping hinge edge arranged to lie at An acute angle relative to the first fold line, the first anchor plate includes a sloping hinge edge arranged to lie at an acute angle to the first fold line, the one end of the first hinge is coupled to the sloping hinge edge of the first bottom flap, and the opposite end of the first hinge is coupled to the sloping hinge edge of the first anchor plate.

40. The container of claim 36, wherein the first bottom flap and the first connector are formed in a single piece of paperboard and the one end of the first hinge is integral to the first bottom flap and the opposite end of the first hinge is integral to the first anchor plate.

41. The container of claim 40, wherein a scored fold line is located at a junction between the first bottom flap and the one end of the first hinge and another scored fold line is located at a junction between the first anchor plate and the opposite end of the first hinge.

42. The container of claim 36, wherein the second connector includes a second anchor plate coupled to the third bottom flap and a second hinge coupled at one end to the fourth bottom flap and at an opposite end to the second anchor plate to establish the second pivot axis.

43. The container of claim 42, wherein the third bottom flap and the second anchor plate lie in coplanar relation to one another and to the first bottom flap and the first anchor plate and in parallel relation to the second and fourth bottom flaps upon movement of the four-sided body to assume the collapsed, flattened position.

44. The container of claim 42, wherein the first bottom flap is coupled to the four-sided body along a first fold line, the first bottom flap includes a sloping hinge edge arranged to lie at an acute angle relative to the first fold line, the first anchor plate includes a sloping hinge edge arranged to lie at an acute angle to the first fold line, the one end of the first hinge is coupled to the sloping hinge edge of the first bottom flap, and the opposite end of the first hinge is coupled to the sloping hinge edge of the first anchor plate, the fourth bottom flap is coupled to the four-sided body along a fourth fold line, the fourth bottom flap includes a sloping hinge edge arranged to lie at an acute angle relative to the fourth fold line, the second anchor plate includes a sloping hinge edge arranged to lie at an acute angle to the fourth fold line, the one end of the second hinge is coupled to the sloping hinge edge of the fourth bottom flap, and the opposite end of the second hinge is coupled to the sloping hinge edge of the second anchor plate.

45. A container comprising a four-sided body and a pair of floor sections positioned to lie in a bottom opening of the four-sided body to define a floor therein upon movement of the four-sided body from a collapsed, flattened position to assume an expanded, opened position, a first of the floor sections includes first and second bottom flaps coupled to the four-sided body along fold lines and a first connector coupled to the first and second bottom flaps and arranged to establish a first pivot axis therebetween to cause the first bottom flap to pivot relative to the second bottom flap during container setup as the four-sided body is moved from the collapsed, flattened position to the expanded, opened position, and a second of the floor sections includes third and fourth bottom flaps coupled to the four-sided body along fold lines and a second connector coupled to the third and fourth bottom flaps and arranged to establish a second pivot axis therebetween to cause the fourth bottom flap to pivot relative to the third bottom flap during container setup as the four-sided body is moved from the collapsed, flattened position to the expanded, opened position, the first, second, third, and fourth bottom flaps extending outwardly from the four-sided body in the collapsed, flattened position.

* * * * *